United States Patent [19]

Mutchler

[11] Patent Number: 4,875,851

[45] Date of Patent: Oct. 24, 1989

[54] STEADY STATE FUEL BURNER ASSEMBLY FOR A HEAT EXCHANGER AND METHOD OF OPERATING SAME

[75] Inventor: Paul A. Mutchler, St. Louis County, Mo.

[73] Assignee: Engineered Air Systems, Inc., St. Louis, Mo.

[21] Appl. No.: 237,445

[22] Filed: Aug. 29, 1988

[51] Int. Cl.[4] ..... F23N 3/02

[52] U.S. Cl. ..... 431/6; 431/12; 431/19; 431/62

[58] Field of Search ..... 431/6, 9, 12, 62, 19, 431/1; 137/512.15, 537, 535, 846, 852, 855, 543.17, 540, 541; 60/39.77

[56] References Cited

U.S. PATENT DOCUMENTS

| | | | |
|---|---|---|---|
| 2,715,390 | 8/1955 | Tenney et al. | 122/24 |
| 2,717,637 | 9/1955 | Huber | 431/158 |
| 2,898,978 | 8/1959 | Kitchen et al. | 431/1 |
| 2,970,430 | 2/1961 | Curtis et al. | 60/39.77 |
| 3,364,969 | 1/1968 | Stephenson | 431/62 |
| 4,364,725 | 12/1982 | Buschulte | 431/62 X |
| 4,457,690 | 7/1984 | Saito et al. | 431/1 |
| 4,640,674 | 2/1987 | Kitchen | 431/1 |
| 4,687,435 | 8/1987 | Matsuzaka et al. | 431/1 |

FOREIGN PATENT DOCUMENTS

| | | | |
|---|---|---|---|
| 1010401 | 4/1983 | U.S.S.R. | 431/6 |
| 202927 | 8/1923 | United Kingdom | 431/6 |

*Primary Examiner*—Margaret A. Focarino
*Attorney, Agent, or Firm*—Polster, Polster & Lucchesi

[57] ABSTRACT

An improved steady state fuel burner assembly and method of operation for a space heater wherein fuel and combustion air are initially ignited within a burner assembly with the resulting higher pressure in the burner assembly causing throttling of combustion air into the burner assembly until a preselected lower pressure is reached compatible with steady state combustion through exhaustion of initially combusted gases.

19 Claims, 2 Drawing Sheets

STEADY STATE FUEL BURNER ASSEMBLY FOR A HEAT EXCHANGER AND METHOD OF OPERATING SAME

BACKGROUND OF THE INVENTION

The present invention relates to space heating apparatus and more particularly to an improved steady state fuel burner assembly for a heat exchanger and an improved method for operating such a burner assembly.

It long has been known in the art of space heating to intermittently throttle or shut-off the flow of fuel and/or air through valve control means responsive to intermittent pressure pulses in the combustion chamber of a pulse type space heater. In this regard, a number of U.S. and foreign patents have been directed toward and disclose pulse type space heaters which utilize unique pulse enhancing valve arrangements in controlling air and/or fuel flow to a pulsing combustion chamber. For example, attention is specifically directed to U.S. Pats. No. 2,898,978, issued to J. A. Kitchen et al on Aug. 11, 1959; No. 4,457,690, issued to Toshihiko Saito et al on July 3, 1984; No. 4,457,691, issued to Satoshi Hissoka et al on July 3, 1984; No. 4,640,674, issued to John A. Kitchen on Feb. 3, 1987, and No. 4,687,435issued to Takashi Matsuzaka on Aug. 18, 1987. Attention is further directed to the Japanese patent publications EP 0066203 of Dec. 1982 to Tokyo Shibaura Denk and EP 0157372 of Oct. 1985 to Toshiba KK and to German Pat. No. 951829 to I. Holzapfel, published on Nov. 8, 1956. These foreign patent publications, like the aforenoted U.S. patents, also teach pulse enhancing valve control arrangements responsive to intermittent pressure pulses in a pulse type space heater to control the flow of fuel and/or air to the heater combustion chamber.

In accordance with the present invention, it is recognized that undesirable pulsation problems and flameouts can occur in steady state fuel burner assemblies—as distinguished from the desirable pulsing which is sought in existing art pulse type heaters as above discussed. The present invention further recognizes that such undesirable pulsation with concomitantly undesirable effects on a steady, efficiently operating flame front is triggered by the high resistance to the flow of combustion products during start-up operations with the sudden expansion of the burning gases at the point of ignition resulting in undersirable flame front oscillations generally along the longitudinal axis of a typically cylindrical combustion chamber or in other directions depending upon the geometrical configuration of the combustion chamber. This undesirable pulsation and the resulting rapid flame front oscillation within the combustion chamber of steady state fuel burner assemblies tends to distort or to even extinguish the flame front since the initial explosion and pulsation blows away the supporting oxygen, thus furthering immediate demands for additional supporting oxygen to maintain the flame front and overcome heat exchanger resistance. This, in turn, has led to further pulsation and inefficient heating operations along with undesirable deposition of carbon materials adjacent the burner assembly inlets in establishing the burner assembly flame front and burner assembly pressure equilibrium. The present invention, recognizing the desirability and importance of promptly establishing flame front equilibrium and stability with concomitant high operating efficiency within the burner assembly and a minimum of carbon deposition, accomplishes the same in a straightforward and efficient manner with a minimum of manufacturing and assembly parts, improving the overall operation of a steady state fuel burner assembly as well as the space heater with which it is associated.

More specifically, the present invention provides a unique valve control mechanism in a space heater fuel burner assembly and method of operation which includes the instant blocking of the reverse flow of the products of combustion of a fuel and air mixture upon ignition. As a consequence, the products of combustion escape downstream from the combustion chamber and heat exchanger to quickly reach an equilibrium pressure normal to steady state combustion, providing an ideal environment for fuel combustion.

Various other features of the present invention will become obvious to one skilled in the art upon reading the disclosure set forth herein.

SUMMARY OF THE INVENTION

More particularly the present invention provides an improved steady state fuel burner assembly for a heat exchanger of a space heater comprising: a burner duct having an upstream inlet end and a downstream outlet end, the inlet end being adapted to be connected to a source of combustion air and the outlet end being adapted to accommodate a burner flame wall proximate thereto; spaced fuel outlet and igniter means selectively position in the burner duct to introduce fuel to ignite with the combustion air to provide a flame wall proximate the outlet end; and, valve control mean cooperating with the upstream inlet end of the burner duct, the valve control means opening during start-up operations and being adaptable to explosive pressures at a higher pressure level created by ignition of fuel with combustion air to promptly throttle the upstream inlet of the burner duct to reduce further introduction of combustion air until the initial products of combustion are exhausted to lower the pressure within the burner duct to a preselected lower pressure level to permit the valve to open the upstream inlet of the burner assembly during regular burner assembly operations for reintroduction of further combustion air to the burner duct to maintain a normal steady flame wall proximate the outlet of the burner duct. In addition, the present invention provides a novel valve control mechanism in the form of a resilient petal valve, several novel alternative valve control mechanisms, and a novel method of operating a steady state fuel assembly. The novel method of operating a steady state fuel burner assembly for a heat exchanger of a space heater comprises the steps of: introducing fuel and combustion air into a burner assembly to provide a mixture and initially igniting the mixture to provide a flame wall proximate the burner assembly; throttling the introduction of further combustion air into the burner assembly in accordance with preselectively high explosive start-up pressures within the burner assembly resulting from the initial start-up ignition; and reintroducing further combustion air into the burner assembly in accordance with exhaustion of the ignited, exploding gases from the burner assembly to provide a preselectively lower pressure within the burner assembly to maintain a normal steady state flame wall.

It is to be understood that various changes can be made by one skilled in the art in one or more of the several parts of the inventive burner assembly and in one or more of the several steps of the inventive method without departing from the scope or spirit of the present invention. For example, various valve control throttling arrangements such as disclosed in FIGS. 4–7 can be utilized besides the novel resilient clover leaf apparatus disclosed and other types of fuel burner assembly structures and configurations can be utilized with the present invention, such as that assembly disclosed in U.S. Pat. No. 4,753,593, issued to Paul A. Mutchler on June 28, 1988.

BRIEF DESCRIPTION OF THE DRAWINGS

Referring to the drawing which discloses one advantageous embodiment of the present invention.

DETAILED DESCRIPTION OF THE INVENTION

Figure 1:
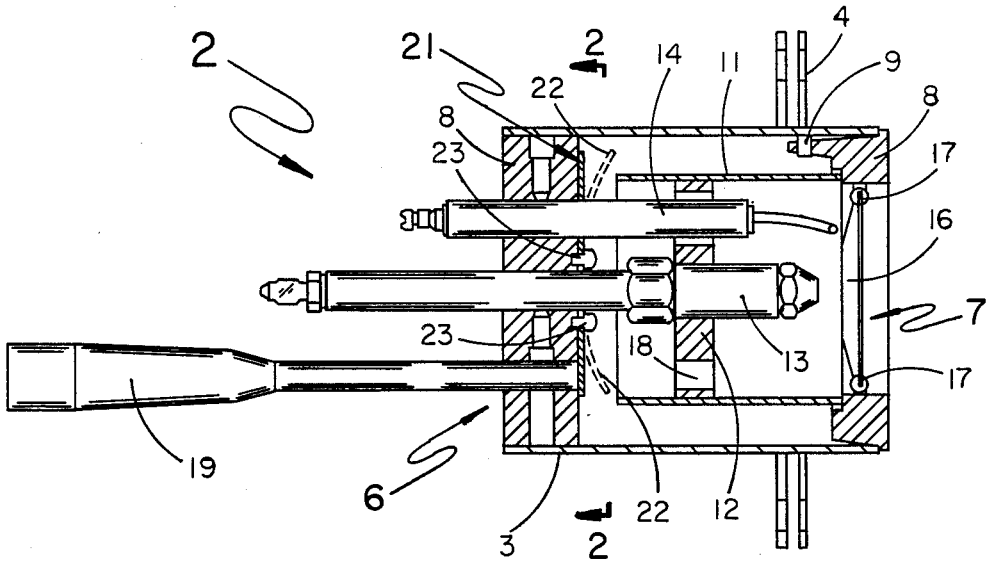
FIG. 1 is a cross-sectioned view of the overall fuel burner assembly of the present invention, disclosing in dotted lines the petals of the valve control in open position at start-up and during steady state equilibrium operations.

Referring to FIG. 1 of the drawing, the overall inventive fuel burner assembly for providing a stable, steady state, nonpulsating flame wall proximate the outlet of the burner duct thereof is broadly referred to by reference numeral 2. Fuel burner, assembly 2 includes a longitudinally extending cylindrical burner duct 3 surrounded by a suitable apertured gasket 4 for appropriate mounting to a space heater combustion chamber (not shown) with which the burner assembly is to be associated. In this regard, it is to be noted that the novel burner assembly described herein is particularly useful for association with combustion chambers and heat exchangers for space heaters offering comparatively high resistance to the burner flame and to the space heater blower, such as those combustion chambers and heat exchangers wherein the ignited gases flow along the central axis of the combustion chambers in a first direction away from the burner assembly flame wall and then flow in a reverse direction to a fuel gas exhaust duct connected to one end of the space heater heat exchanger more proximate to the flame wall of the burner assembly and the space heater blower (not shown, but of a type like that disclosed in U.S. Pat. No. 4,729,365, issued to Paul A Mutchler on Mar. 8, 1988).

The burner duct 3 can be made of a suitable metallic material to resist the high temperatures and wide temperature gradients to which the burner is subjected during heating operations. Duct 3 includes upstream inlet end 6 in the form of three upstream concentrically space flow-through passages of circular cross-section (FIG. 2) and a downstream outlet end 7 (FIG. 1) formed in a pair of spaced peripheral annular support rings 8. Rings 8 can be fastened to the inner wall of duct 3 by any one of a number of suitable means, the rings 8 being fastened to duct 3 in spaced longitudinal alignment by suitable screws 9 (only one of which is disclosed in FIG. 1 of the drawing) passing through appropriate apertures in the wall of duct 3. An inner cylindrical sleeve 11 having suitable perforations in the wall thereof for air passage therethrough is concentrically positioned within and in spaced relation to burner duct 3 to form a fire ring assembly, perforated sleeve 11 being fastened at one end by suitable means such as brazing to the downstream support ring 8 aforedescribed. Inner perforated sleeve 11 in turn supports baffle centering device 12 having appropriately sized and spaced apertures through which fuel supply tube 13 and a pair of spaced electrodes 14 pass in spaced relation to each other. Fuel supply tube 13 and the pair of spaced electrodes 14 are also supported in correspondingly aligned apertures in the upstream end ring 8. In this regard, it is to be noted that the downstream end ring 8 can be provided with a suitable flamelock plate member 16, supported by adjustable mounting screws 17 to be spaced from and adjacent the nozzled end of fuel supply tube 13 and the extremities of the pair of electrodes. Flamelock plate member 16, as well as sleeve 11, can be formed in a manner similar to the fire ring and flamelock plate assembly of above noted U.S. Pat. No. 4,753,593 to provide an enhanced burner flame wall proximate burner duct outlet 7, which is both stable and non-pulsing. It is to be noted that the baffle centering device can be provided with an appropriate aperture 18 for a line of sight photoelectric flame detector assembly 19 suitably supported in an appropriately sized aperture extending through upstream support ring 8.

In accordance with the present invention, it has been recognized that at the instant of flame ignition of atomized fuel and combustion air in past steady state burners that there is an explosion of the combustion gases with a sudden expansion of the products of combustion in all directions including through both the combustion air inlet of the burner assembly and the combustion gas outlet. These expanded gases lead to undesirable carbon deposits along an area proximate to the combustion air inlet to restrict air flow. Further, it is recognized that prior to the initial purge cycle, the temperature inside the combustion chamber served by the burner assembly is near ambient and that within a few milli-seconds after initial ignition of the atomized fuel and combustion air the products of combustion elevate the temperature beyond 2,000° F. This sudden expansion of the burning gases causes the flame front to oscillate or pulse with the pulsing being along the longitudinal axis in the conventional cylindrical combustion chamber. This pulsation tends to increase in intensity due to compressibility of the hot gases in the ignited products of combustion and the combustion air being introduced through the burner assembly inlet. The present invention further recognizes that these flame front oscillations or pulsations are very rapid and necessarily require a fast acting mechanism to control or stop the same. Accordingly, the present invention, having recognized the problems involved, provides such a fast acting mechanism, advantageously in the form of a leaf petal valve control mechanism 21 which can be manufactured from a thin sheet of resilient heat resistant shim stock material of approximately 0.001 to 0.010 inches thickness and, depending upon several of the parameters of the space heater and blower involved, advantageously of approximately 0.003 to 0.005 inches in thickness. The material itself can be a suitable metallic shim stock such as stainless steel or brass or even can be suitably selected heat resistant plastic shim stock.

Figure 2:
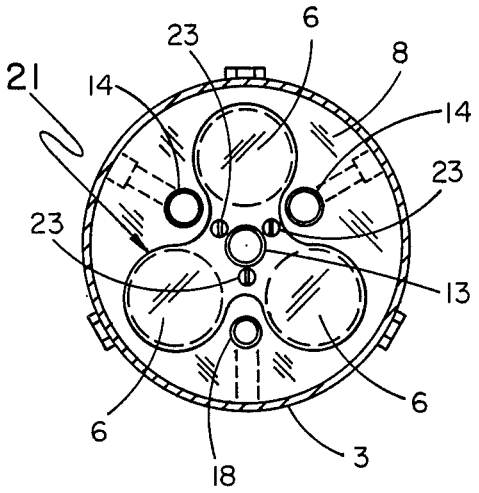
FIG. 2 is a cross-sectional view of the burner assembly of FIG. 1 taken in a plane through line 2—2 of FIG. 1.
Figure 3:
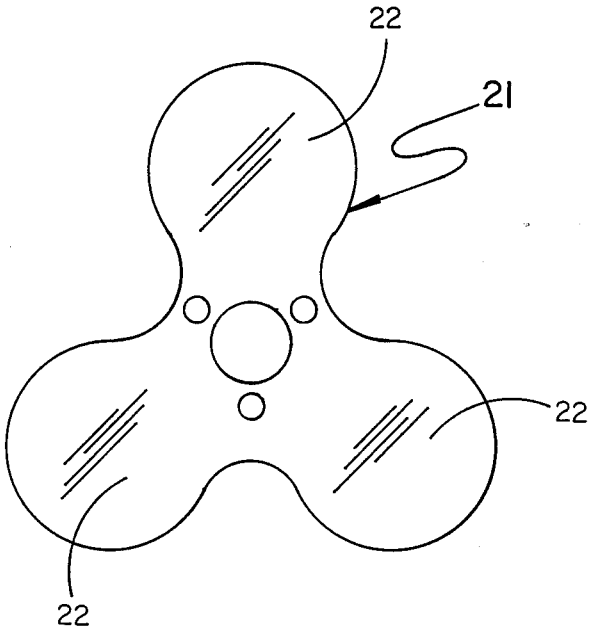
FIG. 3 is an enlarged planar view of the novel clover leaf petal valve of FIG. 2 which serves as one advantageous form of a valve control mechanism in accordance with the present invention.

As disclosed in FIG. 3 of the drawing, the valve control mechanism 21 is in the form of a clover leaf with three petals 22 sized, when in throttling position, to cover so as to limit or close the three concentrically spaced flow-through passages forming upstream inlet end 6 in upstream support ring 8 of fuel burner duct 2. As can be seen in FIG. 2 of the drawing, suitable machine screws 23 serve to fasten leaf valve 21 to upstream support ring 8. It is to be understood that other types of inlets, valves and valve shapes can also be employed without departing from the scope of this invention.

As disclosed in FIGS. 4–7, a modified appropriately sized valve control mechanism also can be utilized with each individual flow-through passage rather than the aforedescribed cloverleaf arrangement 21.

Figure 4:
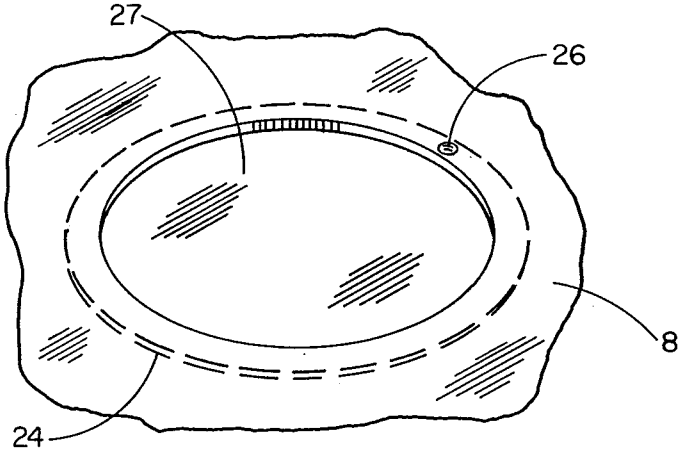
FIG. 4 is an enlarged perspective view of one modified version of a valve control mechanism including a single flexible disk for each flow-through passage which can be utilized in accordance with the present invention.

In this regard, FIG. 4 discloses a single flexible disk valve 24 of suitably thin material, such as described for valve control mechanism 21, fastened at one point along the periphery thereof to support ring 8 by a rivet 26 to cover ~~individual~~ flow-through passage 27 when in throttling position.

Figure 5:
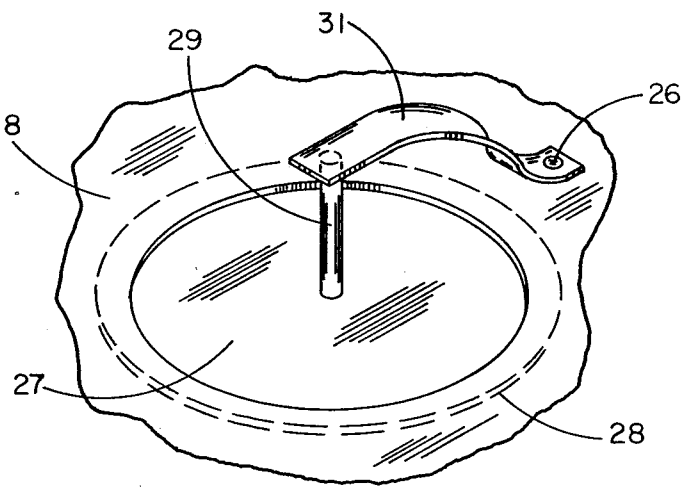
FIG. 5 is a similar perspective view of a second modified version of a valve control mechanism including a resiliently mounted single disk for each flow-through passage which can be utilized in accordance with the present invention.

FIG. 5 discloses a single disk valve 28 made from a suitably heat resistant material and appropriately sized to cover individual flow-through passage 27, disk valve 28 being supported by a centrally disposed pin 29 extending normally from one face thereof, the pin 29 being connected to the spaced end of the flexible arched and cantilevered arm 31 with the other end of arm 31 being fastened to ring 8.

Figure 6:
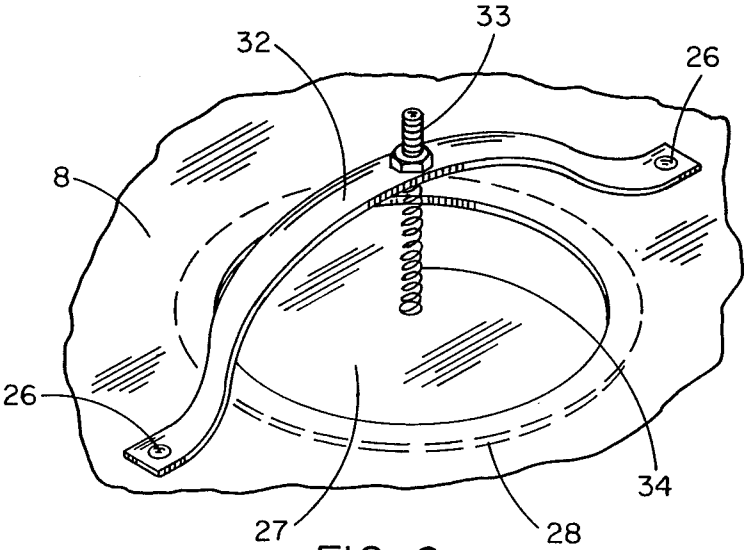
FIG. 6 is a further similar perspective view of a third modified version of a valve control mechanism including a resiliently and adjustably mounted single disk for each flow-through passage which can be utilized in accordance with the present invention.

FIG. 6 discloses a bridge 32 extending in spaced relation over flow-through passage 27, the bridge 32 being fastened at its opposite ends to ring 8 and having a pin 33 adjustably threaded through the apex thereof. A suitable tension spring 34 is fastened at one end to the central face of passage covering disk 28 to extend normally therefrom and at the other end to pin 33 which can be movably adjusted relative bridge 32 to adjust the tension in spring 34.

Figure 7:
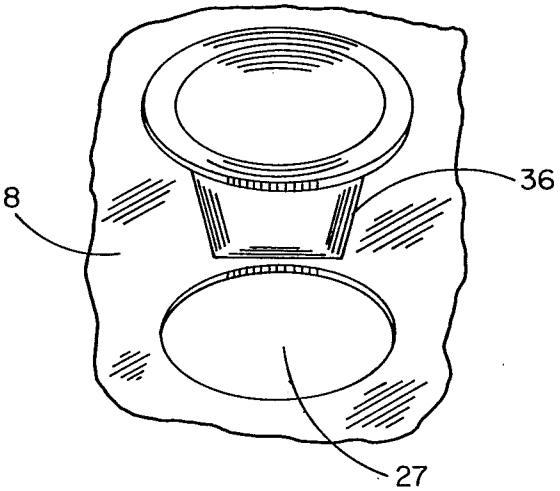
FIG. 7 is an even further similar perspective view of a fourth modified version of a valve control mechanism including a flexible one-way duckbill valve for each flow-through passage which can be utilized in accordance with the present invention.

FIG. 7 discloses in exploded view, a flexible, one-way flow duckbill valve 36 sized to nest in sealed relation with the periphery of passage 27 to allow combustion air to enter into the burner duct 3 through passage 27 and to throttle explosive gases from exiting in reverse direction through passage 27.

In a typical operation of the above described fuel burner assembly structure as disclosed in FIGS. 1–3, fuel and combustion air are introduced into burner duct 3 respectively through fuel supply tube 13 and inlet passages 6 under suitable pressure, the space heater blower (not shown) maintaining resilient leaf petals 22 in open position. In the advantageous embodiment disclosed, the fuel and air are atomized as a mixture and ignited adjacent the downstream end of cylindrical burner duct 3. It is to be understood, however, that other arrangements, configurations and mixing locations also could be employed. When the mixture is ignited, a flame wall is formed proximate the burner assembly and within milli-seconds, further air introduction into burner duct 3 through inlet passages is throttled by the closing of the inlet passages 6 by petals 22 through the explosive pressures within the burner assembly caused by the initial ignition of the atomized fuel-air mixture. When the internal pressures are lowered as a consequence of the exhaustion of the combustion gases, advantageously from the high resistance heat exchanger (not shown), and a lower pressure equilibrium has been established between the burner assembly and the associated combustion chamber (not shown)—which also can be in a matter of milli-seconds, the blower pressures cause resilient petals 22 to open inlet passages 6 with further combustion air being introduced into the burner duct 3 to maintain a normal steady state flame wall proximate the outlet end 7 of burner duct 3. In a typical operation, the petals 22 of petal valve 21 can be adjusted to be urged to closed position when the pressure differential on opposite faces of the petals 22 is less than 0.1 inches of $H_2O$ and to open when such pressure on opposite faces of petals 22 is more than 0.25 inches of $H_2O$. Thus, these petals 22 act as check valves against the expanding products of combustion until desired equilibrium and one way flow is established in the space heater. In this regard, it is to be understood that petal valve 21 operates only once or twice at the moment of flame establishment, then remains open for the "on" cycle of the burner assembly and space heater—which can be for only a few minutes to hundreds of hours or even continuously.

Thus, the present invention provides an economical, straight-forward arrangement which enhances the rapid establishment of steady state flame wall stability and at the same time minimizes undesirable carbon depositions proximate the burner assembly inlet.

The invention claimed is:

1. In combination with a steady state normally continuous, even flow fuel burner assembly for a heat exchanger of a space heater comprising:

a burner duct having an upstream inlet end and a downstream outlet end, said inlet end being adapted to be connected to a source of normally continuous, even flow combustion air and said outlet end being adapted to accommodate a burner flame wall proximate thereto;

spaced fuel outlet and igniter means selectively positioned in said burner duct to introduce a continuous, even flow of fuel to ignite with said combustion air to provide a flame wall proximate said outlet end; and valve control means cooperating with said upstream inlet end of said burner duct, said valve control means opening during start-up operations and being adaptable only upon initial high explosive pressures created by the ignition of said fuel with said combustion air to throttle said upstream inlet of said burner duct to reduce the further introduction of combustion air until the initial products of combustions are exhausted to lower the pressure within said burner duct to a preselected lower pressure level to permit said valve control means to open said upstream inlet of said burner assembly operations for continuous, even flow of further unthrottled combustion air to said burner duct to maintain a normal steady state flame wall free of pulsations proximate said outlet end of said burner duct.

2. The improved fuel burner assembly for a heat exchanger of claim 1, said spaced fuel outlet and igniter means being positioned proximate said outlet end of said burner duct.

3. The improved fuel burner assembly for a heat exchanger claim 1, said valve control means being responsive to close said of upstream inlet end only until the initial products of combustion are exhausted from said heat exchanger.

4. The improved fuel burner assembly for a heat exchanger of claim 1, said valve control means comprising a resilient leaf petal valve positioned adjacent said upstream inlet end of said burner duct to be in normally open position during burner assembly start-up operations and adapted to be moved only to throttling position in response to start-up explosive pressures to throttle combustion air until the products of combustion are exhausted to said preselected pressure level to permit restoration of said petal valve to open position continuously during regular burner assembly operations.

5. The improved fuel burner assembly for a heat exchanger of claim 1, said valve control means including a duckbill valve sized to nest in sealed relation with the periphery of said upstream inlet to allow combustion air to enter said burner duct through said upstream inlet during start-up operations and to instantly throttle said upstream inlet only when high explosive pressures created by ignition occur.

6. The improved fuel burner assembly for a heat exchanger of claim 1, said valve control means including a disk member resiliently positioned relative said upstream inlet ~~to be~~ open to said inlet during start-up operations and being instantly responsive to said high explosive pressures only upon ignition to throttle said upstream inlet.

7. The improved fuel burner assembly for a heat exchanger of claim 1, said valve control means including a flexible disk member fastened at one point along the periphery of said burner duct and sized to cooperate with said upstream inlet to open during start-up operations and being only instantly responsive to high explosive pressures created by the ignition of said fuel with said combustion air to throttle said upstream inlet.

8. The improved fuel burner assembly for a heat exchanger of claim 1, said valve control means including a disk member sized to cooperate with said upstream inlet, said disk member having one face thereof centrally fastened to one end of an arched cantilevering arm extending in spaced relation to said upstream inlet with the opposite end of said arm being fastened to said burner duct so that said disk member can be in open position during start-up operations and be only instantly responsive to said high explosive pressures upon ignition to throttle said upstream inlet.

9. The improved fuel burner assembly for a heat exchanger of claim 1, said valve control means including a disk memeber sized to cooperate with said upstream inlet, a bridge member extending in spaced relation over said upstream inlet in spaced relation thereto with the opposite ends thereof fastened to said burner duct and a resiliently adjustable linkage means connecting the apex of said bridge member to a face of said disk member to permit said disk member to be open to said upstream inlet during start-up operations and to be only instantly responsive to said high explosive pressures upon ignition to throttle said upstream inlet.

10. The improved fuel burner assembly for a heat exchanger of claim 1, said upstream inlet end in said burner duct comprising at least three equally and concentrically spaced flow-through air inlet passages at the upstream end of said burner duct and a resilient clover-like leaf petal valve with the leaves thereof positioned adjacent said passages to be in normally open position therewith during start-up operations and adapted to be only instantly moved to throttling position in response to explosive start-up pressures to throttle combustion air until the products of combustion are exhausted to said preselected pressure level to permit restoration of said leaves of said petal valve to open position during regular burner assembly operations.

11. The improved fuel burner assembly for a heat exchanger of claim 10, said clover leaf petal valve being formed from a resilient stainless steel shim stock of approximately 0.003 to 0.005 inch thickness.

12. The improved fuel burner assembly for a heat exchanger of claim 10, said clover leaf petal valve being formed from a resilient brass shim stock of 0.003 to 0.005 inch thickness.

13. The improved fuel burner assembly for a heat exchanger of claim 10, said clover leaf petal valve being formed from a preselected, resilient heat resistant sheet stock material of approximately 0.003 to 0.005 inch thickness.

14. The improved burner assembly for a heat exchanger of claim 10, said clover leaf petal valve being formed from a preselected, resilient heat resistant sheet stock material adapted to be closed when the pressure differential on opposite faces of the petal valve is less than 0.1 inches of $H_2O$ and to open when such pressure differential on opposite faces is more than 0.25 inches of $H_2O$.

15. A method of operating a steady state normally continuous, even flow fuel burner assembly for a heat exchanger of a space heater comprising:

introducing fuel and combustion air into a burner assembly to provide an atomized mixture and initially igniting the mixture to provide a flame wall proximate said burner assembly;

automatically throttling the initial introduction of said combustion air into said burner assembly only in instant response to preselectively high explosive start-up pressures within said burner assembly resulting from said initial ignition; and introducing further combustion air in normally continuous, even flow into said burner assembly in accordance with exhaustion of said ignited gases from said burner assembly to provide a preselectively lower pressure within said burner assembly to maintain a normal steady state flame wall free of pulsations.

16. The method of operating a steady state normally continuous, even flow fuel burner assembly for a heat exchanger of claim 15, wherein further combustion air is introduced in normally continuous, even flow into said burner assembly in response to the exhaustion of said ignited gases from said heat exchanger.

17. The method of operating a steady state normally continuous, even flow fuel burning assembly for a heat exchanger of claim 15, wherein said fuel and combustion air are initially ignited adjacent the downstream end of said burner assembly.

18. The method of operating a steady state normally continuous, even flow fuel burning assembly for a heat exchanger of claim 15, wherein introduction of further combustion air in normally continuous, even flow occurs only when a preselected lower equilibrium pressure within said burner assembly is attained.

19. The method of operating a steady state fuel burner assembly for a heat exchanger of claim 15, wherein the introduction of combustion air into the burner assembly is throttled only when the pressure differential internally and externally of the assembly is less than 0.1 inches of $H_2O$ and is "on-stream" when such pressure differential exceeds 0.25 inches of $H_2O$.

* * * * *